US005738570A

United States Patent [19]

Rosenthal et al.

[11] Patent Number: 5,738,570

[45] Date of Patent: Apr. 14, 1998

[54] ARRANGEMENT FOR MACHINING ROLLS DURING THE ROLLING OPERATION

[75] Inventors: Dieter Rosenthal, Niederfischbach; Günter Kneppe, Hilchenbach, both of Germany

[73] Assignee: SMS Schloemann-Siemag Aktiengesellschaft, Düsseldorf, Germany

[21] Appl. No.: 406,031

[22] Filed: Mar. 17, 1995

[30] Foreign Application Priority Data

Mar. 18, 1994 [DE] Germany ..... 44 09 300.4

[51] Int. Cl.[6] ..... B24B 7/00

[52] U.S. Cl. ..... 451/119; 451/49; 451/142; 451/425

[58] Field of Search ..... 451/119, 121, 451/123, 124, 142, 140, 156, 425, 5, 56, 49, 55, 504, 242, 246, 245, 514, 529, 531

[56] References Cited

U.S. PATENT DOCUMENTS

| | | | |
|---|---|---|---|
| 1,279,219 | 9/1918 | Baird | 451/425 |
| 1,429,317 | 9/1922 | Bagi | 451/142 |
| 1,988,578 | 1/1935 | Scrimgeour . | |
| 3,468,075 | 9/1969 | Armstrong | 451/425 |
| 3,604,239 | 9/1971 | Moxon | 451/49 |
| 3,868,791 | 3/1975 | Burns . | |
| 4,707,950 | 11/1987 | Kawasaki . | |
| 5,203,118 | 4/1993 | Bocquet | 451/297 |

FOREIGN PATENT DOCUMENTS

| | | |
|---|---|---|
| 0605833 | 7/1994 | European Pat. Off. . |
| 0640412 | 3/1995 | European Pat. Off. . |

OTHER PUBLICATIONS

Mitsubishi Heavy Industries Ltd. Technical Review, vol. 29, No. 3, Oct. 1993, pp. 171–176.

Patent Abstracts of Japan vol.8, No. 136 of Jun. 23, 1984: JP–A–59 035 821 (Kawasaki Seitetsu et al.) of Feb. 27, 1984.

Patent Abstracts of Japan vol.8, No.136 of Jun. 23, 1984: JP–A–59 035 819 (Kawasaki Seitetsu et al.) of Feb. 27, 1984.

Patent Abstracts of Japan vol. 9,No. 282 of Nov. 9, 1985: JP–A–60 124 409 (Sumitomo Kinzogu Kogyo) of Jul. 3, 1985.

Patent Abstracts of Japan vol.16, No.217 of May 21, 1992: JP–A–04 041 008 (Ishikawajima Harima Heavy Ind) of Feb. 12, 1992.

Patent Abstracts of Japan vol.9,No.25 of Feb. 2, 1985: JP–A–59 169 758 (Toshiba) of Sep. 25, 1984.

*Primary Examiner*—Robert A. Rose
*Assistant Examiner*—George Nguyen
*Attorney, Agent, or Firm*—Friedrich Kueffner

[57] ABSTRACT

An arrangement for working or machining rolls which are mounted through chocks in roll housings. The arrangement includes a unit with abrasives for each roll, wherein the unit is mounted so as to be rotatable relative to the roll and so as to be adjustable relative to the roll. The adjustable unit includes a roller mounted in the chock of the roll to be subjected to grinding, wherein the roller is adjustable through bearings thereof relative to the roll to be subjected to grinding.

9 Claims, 2 Drawing Sheets

ARRANGEMENT FOR MACHINING ROLLS DURING THE ROLLING OPERATION

BACKGROUND OF THE INVENTION

1. Field of the Invention

The present invention relates to an arrangement for working or machining rolls which are mounted through chocks in roll housings. The arrangement includes a unit with abrasives for each roll, wherein the unit is mounted so as to be rotatable relative to the roll and so as to be adjustable relative to the roll.

2. Description of the Related Art

Online grinding arrangements of this type are used to be able to make rolling program schedules more flexible, on the one hand, and to increase the time periods between roll changes which are required for reasons of roll wear, on the other hand.

Grinding arrangements of this type have become known from an essay in "Mitsubishi Heavy Industries Ltd. Technical Review, Vol. 29, No. 3, Oct. 1993, Pages 171–176". In that case, a number of solid non-driven grinding disks, whose axes of rotation extend essentially perpendicularly to the roll axes, are adjusted relative to the roll to be subjected to grinding in such a way that the grinding disk is rotated, while there always remains a relative movement between the roll and the grinding disk. In order to machine the roll body over the entire length thereof, the grinding disks are subjected to an oscillating movement in axial direction of the roll.

In another similar online grinding arrangement, the solid grinding disks are replaced by flexible grinding disks and the grinding disks are coupled to the drive.

Both online grinding arrangements have the disadvantage that they require a substantial amount of space in the roll stand where space is already limited. In addition, all components of these grinding arrangements are located above or below the strip entry area or the strip exit area of the stand where they may become damaged, for example, when the strip being rolled is damaged. Also, the grinding arrangements are expensive and always constitute an obstacle when rolls are changed.

In the field of rolling of aluminum, it has already become known to arrange roll-shaped brushes parallel to the work rolls and to mount the roll-shaped brushes in the chocks. These brushes have the purpose of cleaning the rolls. However, these brushes are not capable of machining the rolls, such as, grinding the rolls.

SUMMARY OF THE INVENTION

Therefore, it is the primary object of the present invention to provide a simple and inexpensive arrangement for grinding rolls during the rolling operation, wherein the arrangement requires little space in the areas of the strip entry side and the strip exit side and wherein the arrangement does not represent an obstacle during the roll change.

In accordance with the present invention, the adjustable unit includes a roller mounted in the chock of the roll to be subjected to grinding, wherein the roller is adjustable through bearings thereof relative to the roll to be subjected to grinding.

A roller mounted in the chocks can be manufactured simply and inexpensively. The adjustable unit is not arranged in the areas of the strip entry side and the strip exit side and, when rolls are exchanged, the entire grinding unit is removed together with the chocks of the rolls and can be easily inspected in the disassembled state.

In accordance with another feature of the present invention, the sleeve of the roller is of elastic construction. The sleeve of the roller may be of an elastic skein or may have a brush-like or mop-like construction. This ensures that the hard abrasive is not damaged when the roller is subjected to bending. In addition, the elastic sleeve of the roller produces smooth transitions of the ground roll body.

Another feature of the present invention provides that the length of the roller corresponds essentially to the length of the roll body. In that case, an oscillating movement of the roller is unnecessary.

In accordance with another feature, the roller is divided into at least two portions which are individually elastically mounted on a shaft supported in the chocks. This feature makes it possible to produce even better and smoother transitions of the ground roll body.

As a result of the inertia and friction of the roller, an adjustment position of the roller could be found in which the roller is driven for rotation by being dragged, while a relative movement between roller and roll would still be present. However, the relative movements can be obtained more easily if the roller is driveable and brakeable.

Very complex grinding contours can be achieved if the individual roller portions are driveable and brakeable.

In accordance with another feature, the roller or the individual roller portions are driveable in an oscillating manner in axial direction by means of a displacement drive. As a result, it is possible to achieve a more uniform roll contour.

By additionally bending the roller and/or by additionally providing the roller with a contour, even more complex grinding contours of the roll can be achieved.

In accordance with another advantageous feature, a control device is provided which, in dependence on the surface contour of the roll to be subjected to grinding, controls at least one of the drives for adjusting, rotating, axially displacing and bending in such a way that the actual contour of the roll to be subjected to grinding is approximated in an optimum manner to a desired contour.

The various features of novelty which characterize the invention are pointed out with particularity in the claims annexed to and forming a part of this disclosure. For a better understanding of the invention, its operating advantages attained by its use, reference should be had to the drawings and descriptive matter in which there are illustrated and described preferred embodiments of the invention.

DESCRIPTION OF THE PREFERRED EMBODIMENTS

Figure 1:
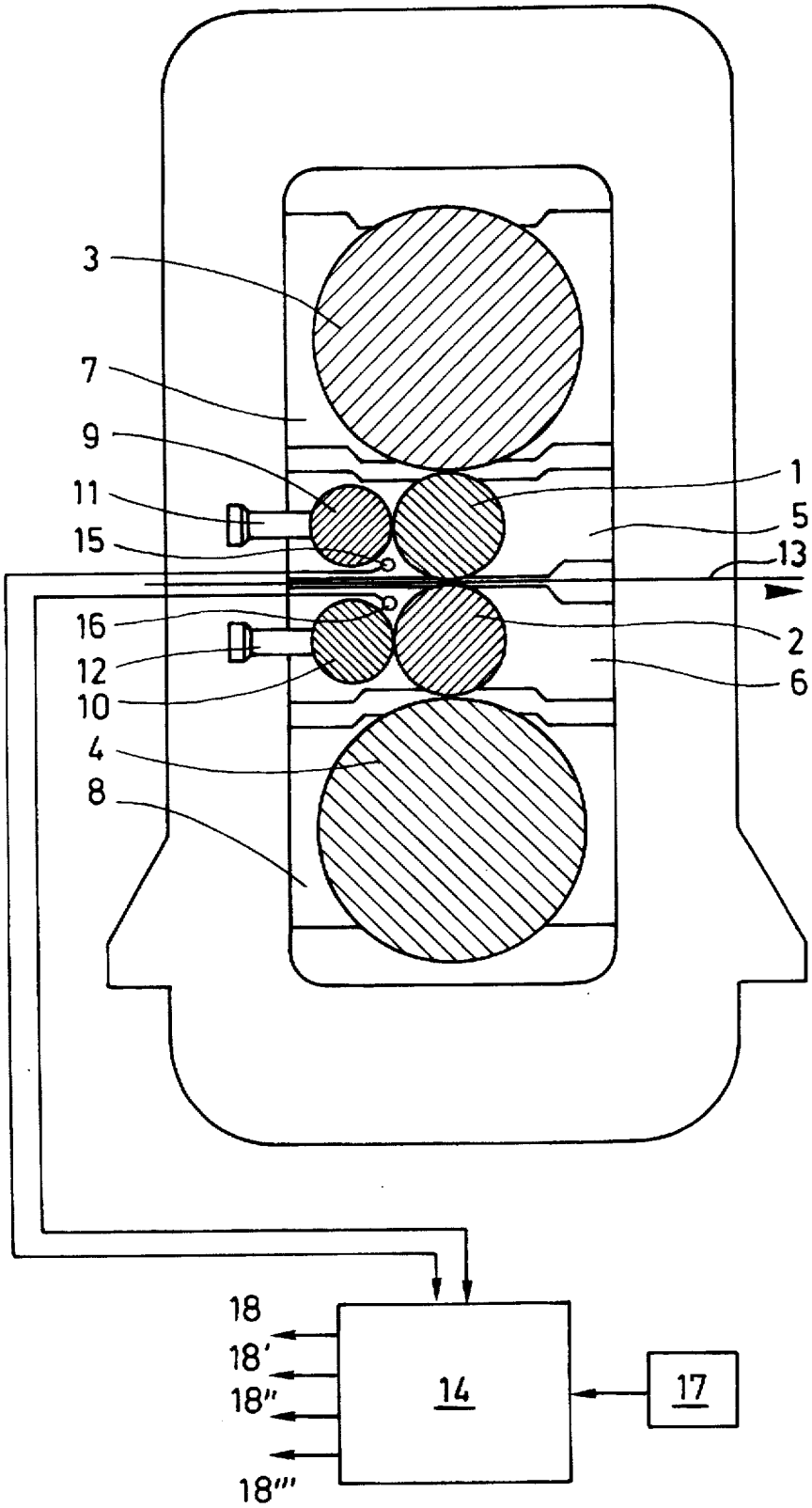
FIG. 1 is a schematic side view, partially in section, of a four-high roll stand with the grinding device according to the present invention.

FIG. 1 of the drawing shows work rolls 1, 2 and back-up rolls 3, 4 of a four-high roll stand. The work rolls 1, 2 are mounted in chocks 5, 6 and the back-up rolls 3, 4 are mounted in chocks 7, 8. The chocks 5 to 8 are guided so as to be adjustable relative to each other in a housing.

Rollers 9, 10 are additionally mounted in the chocks 5, 6. Through guides, not shown, the rollers 9, 10 can be moved toward and away from the work rolls 1, 2. Adjusting cylinders 11, 12 are used for the adjustment. Accordingly, in the area of the inlet of the strip 13, only the rollers 9, 10 are provided, while the adjusting cylinders 11, 12 are arranged outside of this area in the chocks 5, 6.

FIG. 1 additionally shows a control device 14. Actual contour values are supplied from actual value sensors 15, 16 to the control device 14. The desired values are supplied through an input/storage unit 17. The outputs 18, 18', 18", 18'" of the control device 14 control the adjusting cylinders 11, 12 and the drives, not shown, for rotating, bending and axially displacing the rollers.

Figure 2:
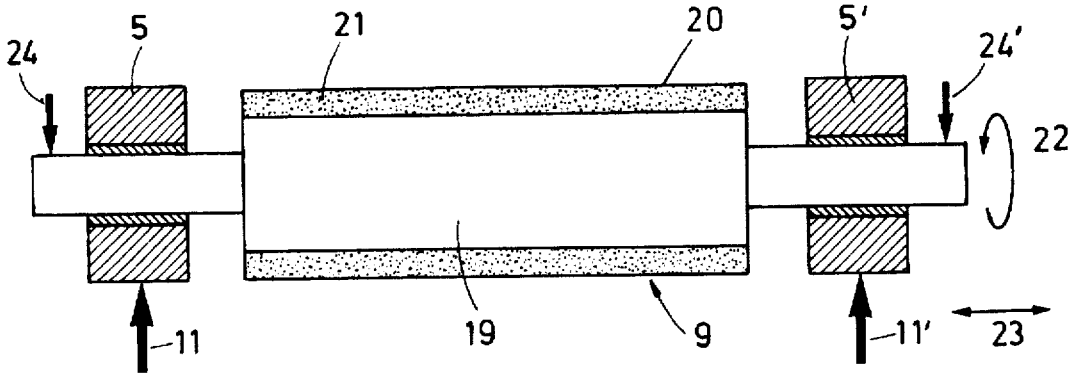
FIG. 2 is a sectional view of a roller of the grinding device of FIG. 1.

FIG. 2 of the drawing shows the roller 9 which is mounted in the chocks 5, 5' of the work roll 1 which is not illustrated in FIG. 2. The roller 9 has a roller body 19 and a roller sleeve 20 of an elastic skein, wherein the abrasive 21 is contained in the skein. In addition to the adjusting cylinders indicated by arrows 11, 11', acting on the roller 9 are a rotary drive 22, an axial displacement drive 23 and a bending drive 24, 24' which are also only indicated by arrows.

Figure 3:
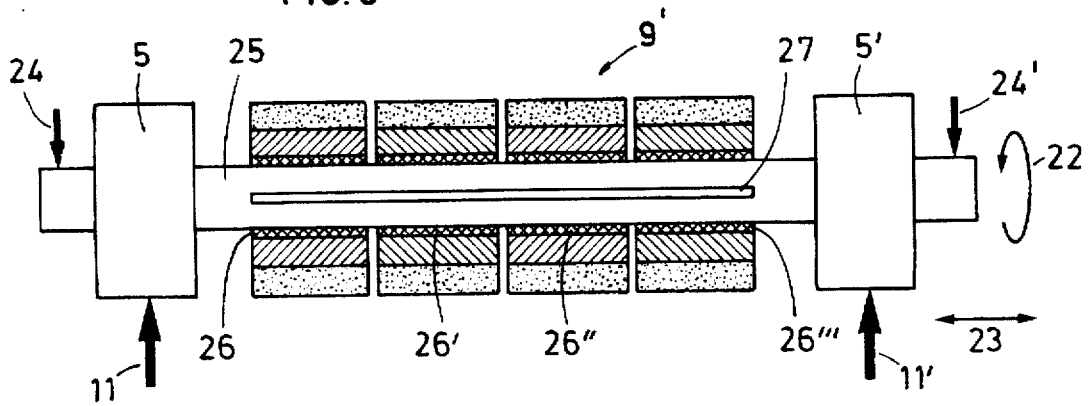
FIG. 3 is a sectional view of a divided roller of the grinding device of FIG. 1.

As illustrated in FIG. 3, the roller 9' is divided into four portions which are supported on a shaft 25 which is rotatably mounted in the chocks 5, 5'. The support is effected by means of elastic sleeves 26, 26', 26", 26'" which permit slight pivoting movements of the roller portions on the shaft 25. A drive member 27 of the shaft 25 engages into a groove, not shown, of the roller portions. Provided also in this case are adjusting drives 11, 11', rotary drives 22, axial displacement drives 23 and bending drives 24, 24'.

Figure 4:
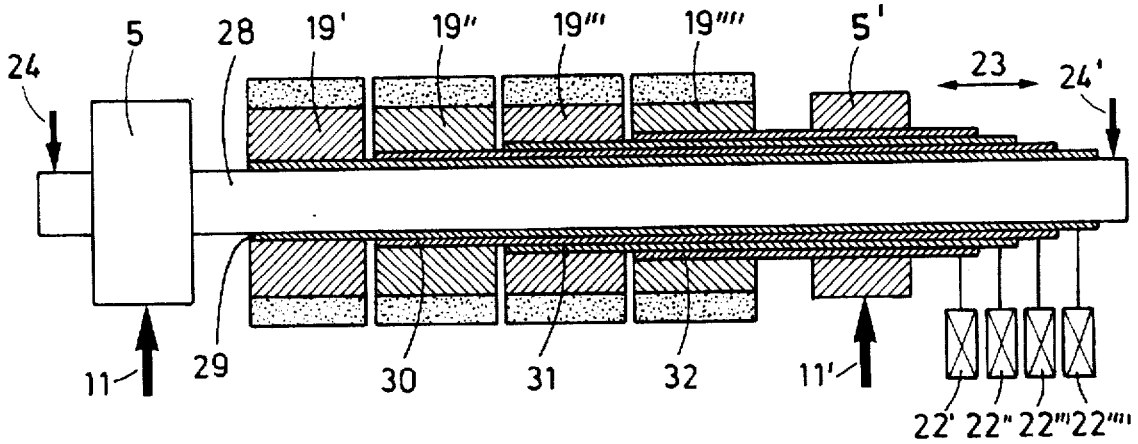
FIG. 4 is a sectional view of a divided roller with individual drives for each roller portion.

FIG. 4 of the drawing shows an axle 28 mounted in the chocks 5, 5'. Shafts 29, 30, 31, 32 are coaxially mounted on the axle 28. The shafts 29, 30, 31, 32 are individually driveable and brakeable through rotary drives 22', 22", 22'", 22"". The individual roller portions 19', 19", 19'", 19"" are connected for rotation to the shafts 29, 30, 31, 32 through drive members, not shown. Also in this case, adjusting drives 11, 11', axial displacement drives 23 and bending drives 24, 24' are provided. Of course, the roller portions may also be supported on the shafts 29, 30, 31, 32 through elastic sleeves.

While specific embodiments of the invention have been shown and described in detail to illustrate the application of the inventive principles, it will be understood that the invention may be embodied otherwise without departing from such principles.

We claim:

1. An arrangement for grinding contours of rolls during a rolling operation, wherein the rolls are an adjustable grinding roller for each roll to be subjected to grinding, the adjustable roller having bearings, the adjustable roller being mounted through the bearings in the chocks of the roll, the roller comprising an abrasive, wherein the roller is adjustable through the bearings relative to the roll, and wherein the roller has a sleeve of elastic construction, and wherein the abrasive is incorporated into the sleeve.

2. The arrangement according to claim 1, wherein the roller has a length and wherein the roll has a roll body having a length, and wherein the length of the roller essentially is the same as the length of the roll body.

3. The arrangement according to claim 1, wherein the roller comprises at least two roller portions, a shaft extending through the roller portions, wherein the roller portions are individually elastically mounted on the shaft, further comprising drive members for connecting the roller portions to the shaft.

4. The arrangement according to claim 1, comprising a rotary drive for the roller for producing a positive or negative acceleration of the roller.

5. The arrangement according to claim 3, comprising a plurality of shafts arranged coaxially relative to each other, wherein each roller portion is mounted on a shaft, and wherein a drive for effecting positive or negative accelerations is connected to each shaft.

6. The arrangement according to claim 1, comprising a displacement drive for driving the roller in axial direction in an oscillating manner.

7. The arrangement according to claim 1, comprising a bending drive for bending the roller.

8. The arrangement according to claim 1, wherein the roller has a predeterminable contour.

9. The arrangement according to claim 1, further comprising a control device, the roll having a surface contour, the roller having an adjusting drive, a rotary drive, an axial displacement drive and a bending drive, the control device comprising means for controlling at least one of the adjusting drive, the rotary drive, the axial displacement drive and the bending drive such that the roll is machined to adapt an actual contour of the roll to a predetermined desired contour of the roll.

* * * * *